US005123601A

United States Patent [19]

Lavin et al.

[11] Patent Number: 5,123,601

[45] Date of Patent: Jun. 23, 1992

[54] TABLET OR PILL PULVERIZER

[76] Inventors: Janice A. Lavin; Terence J. Lavin, both of 242 Lake Shore Dr., Crystal Lake, Ill. 60014

[21] Appl. No.: 637,136

[22] Filed: Jan. 3, 1991

Related U.S. Application Data

[63] Continuation of Ser. No. 492,743, Mar. 13, 1990, Pat. No. 5,025,996.

[51] Int. Cl.[5] ..... B02C 19/08

[52] U.S. Cl. ..... 241/168; 241/DIG. 27

[58] Field of Search ..... 81/300, 319, 321, 324; 241/30, 168, DIG. 27

[56] References Cited

U.S. PATENT DOCUMENTS

| | | | |
|---|---|---|---|
| D. 274,647 | 7/1984 | Johnson | D24/10 |
| D. 285,966 | 9/1986 | Porter | D24/23 |
| 2,631,786 | 3/1953 | Morgan et al. | 241/DIG. 27 |
| 2,881,649 | 4/1959 | Ball et al. . | |
| 3,915,393 | 10/1975 | Elkins | 241/168 |
| 4,003,523 | 1/1979 | Doolittle | 241/169.2 |
| 4,341,356 | 7/1982 | Hiott et al. | 241/169.2 |
| 4,366,930 | 1/1983 | Trombetti, Jr. | 241/169 |

FOREIGN PATENT DOCUMENTS

| | | |
|---|---|---|
| 200972 | 6/1983 | European Pat. Off. . |
| 631995 | 9/1986 | Fed. Rep. of Germany . |

*Primary Examiner*—Timothy V. Eley
*Attorney, Agent, or Firm*—Mathew R. P. Perrone, Jr.

[57] ABSTRACT

A tablet pulverizer for crushing a pill or tablet, wherein the pulverizer includes a convex arm and concave arm. The concave arm has a smooth, arcuate crushing surface which nests with a smooth, convex crushing surface on the convex arm. The meshing of these smooth, arcuate, nesting arms provide a substantial crushing surface to be applied to the pill or tablet for crushing the same without damaging the pill container.

14 Claims, 1 Drawing Sheet

TABLET OR PILL PULVERIZER

CROSS-REFERENCE TO RELATED APPLICATION

This application is a continuation application of U.S. patent application Ser. No. 07/492,743 filed Mar. 13, 1990 now U.S. Pat. No. 5,025,996.

This invention relates to a method and apparatus for crushing pills used for medicine and more particularly to a tablet pulverizer including a spring loaded pliers type device having flat, arcuate, nestable jaws for crushing pills therebetween.

BACKGROUND OF THE INVENTION

In many cases for a patient to effectively take medicine in tablet or pill form, it is necessary to crush medicine so formed. Throughout this application, pill and tablet may be used interchangeably. The crushed pill is then dispersed in a food carrier and fed to the patient—thereby delivering the medicine to the patient.

Such pill crushing is necessary for infants. It has also become necessary for some groups of elderly people. This is especially true of people confined to nursing homes. Some people confined to nursing homes have lost the physical skills necessary for swallowing a pill. It thus becomes necessary to crush the pill or tablet, mix the crushed pill or tablet with a food such as applesauce or similar food and spoon feed the medicine to the patient.

Commonly, a pill is either in a prepackaged envelope as a container or put in a paper cup as a container. The crushing device must be able to crush the pill without ripping the container. If the container is not ripped as the pill is crushed, the crushed pill can effectively be mixed with a food stuff. The mixture may then be fed to the patient. Thus, the pill may be taken with greatly minimized loss of the medication.

Many devices are known in the art for crushing pills. All of the known devices have caused great difficulty for the nursing staff or other users thereof. The known devices for crushing a pill or a tablet are so inefficient, that it is known to use a substitute, such as crushing a pill in a door jamb or pounding the pill. Yet, the pill must be crushed efficiently and removed from the pill container efficiently. The pill must also then be dispersible in food efficiently.

It is common for a patient in a nursing home to take a large plurality of pills. The time it takes to crush and dispense these pills into a food occupies a great portion of scarce nursing time. An efficient device for crushing the pills can be of great assistance to the nurse delivering the medicine.

In the State of Illinois alone, there are over one thousand nursing homes—including, but not limited to, homes for the developmentally disable, and mentally retarded and mentally ill. Then there are both skilled and intermediate care homes for the aged. It is safe to assume that the average facility has at least one hundred beds. Thus, there are approximately 100,000 beds in the State of Illinois devoted to long term care.

From a statistical standpoint, approximately thirty (30%) percent of these people so confined cannot swallow medications in the form of tablets or pills. When the prescribed medication comes only in the form of a tablet or pill and not in liquid form, the patient must therefore have each medication crushed into powder form.

By a study of forty facilities, it is known that the average patient takes six medications at least twice daily. This means that the average patient requires that twelve pills be crushed each day. In turn, the result becomes over 360,000 pills are being crushed daily in the State of Illinois alone.

It follows that the amount of time this pill crushing is taking nationwide must be incredible. The most efficient, safe and yet fast tool to do this job of pill or tablet crushing is necessary so that every minute saved can be spent with the patients in doing other necessary procedures. This pill crushing, while time-consuming and time-wasteful, is important enough to require a nurse. Such a wasteful use of nursing time greatly aggravates to the nursing shortage in this country, which is already in critical shape. One need only survey a hospital or a nursing facility to confirm this shortage. The nurse needs to have a safe, speedy and efficient tool with which to crush the medications of the patients, either in hospitals or nursing facilities, that are assigned her care.

Typical of the pill crusher of the prior art are serrated cylindrical devices. These devices have rough edges which either tear the package in which the pill is contained or retain a portion of the pill within the rough crushing area. The tearing of the package has a number of undesirable effects—including, but not limited to, loss of the medicine. The residual medicine in the rough area is a contaminant, which renders the crusher unsuitable for use with other medicines.

Other crushing devices provide for an inconvenient way of holding the pill as it is being crushed. Still other pounding devices crush the pill inefficiently and the noise created by pounding is disturbing to the patients. Thus, it is desirable to find an efficient crushing device for pills. If this can be accomplished, great advantages are obtained.

The need, then, for the patient is:

1) to have his or her medications crushed if they are unable to swallow them whole, and if they do not come in a liquid form;
2) to have these medications crushed so that they are pulverized finely enough and put into a soft food substance so that they can be swallowed without danger of choking;
3) to have these medications crushed in a quiet, undisturbing manner (many methods require pounding or hammering on the pills which is done on the medicine cart near the patient); and
4) to have the above named process of pill-crushing done as rapidly as possible, so that the nurse can be available for other bedside care.

Noise caused by pounding to pulverize the pills and other noise of this nature confuse the elderly and already confused patients, and cause them to wonder where the knocking is coming from. At night, this noise can actually cause disrupted sleep. For residents with Alzheimer's Disease and other related dementias, it is of utmost importance to keep a quiet atmosphere.

One type of currently available pill-crusher is a personal, screw-type device made of a plastic. This device cannot be used with unit dose packaging that is common to institutions such as nursing homes or hospitals. Another problem is that this device becomes grossly contaminated with medication particles without cleaning between each patient use. This cleaning is far too time consuming. Furthermore, just screwing a top down onto the bottom portion where pills are placed does not always crush the pill with ease—especially those pills with a hard coating. Additionally, this plastic is not durable enough for constant, institutional use. A crusher can be used recommended for home use for one patient.

Crushers with handles for compressing and crushing pills in a medicine cup generally come in either a plastic or a stainless steel version. These devices cannot be used to crush a pill or tablet while it is still in a unit dose package, thus causing another time consuming step (taking pills out and placing them in a medicine cup, then placing the cup into the crusher). These handle-operated crushers tend to "flatten" pills instead of pulverizing them. Sometimes it takes many strokes of the handle to break up pills. The stainless steel model is heavy, and the plastic version is not durable enough for constant use. Both items take up a lot of space on top of the medicine cart. When some medications that are difficult to crush require repeated thrusts of the handle, that movement causes disturbing noise.

Pounding type devices do not work any better than crushing devices. Typical pounding devices include mortar and pestal, hammer, and other heavy objects. Some receptacles for the pills in these devices are small and therefore, the pills cannot be crushed while still in their unit does package. Pounding is loud and causes much confusion for the residents. Alzheimers or dementia type patients become agitated when they do not understand where the pounding is coming from. Many patients report that it is difficult to sleep when nurses are causing so much noise when crushing pills in the hallway.

Glass mortars can break when firm pounding is required. If pills are taken out of the package and placed into the pill receptacle of the pounding device, cleaning of the device afterwards becomes a major problems, as it is again time consuming.

It becomes clear that a major improvement in a pill crusher can be a distinct advantage for the nurse.

SUMMARY OF THE INVENTION

Accordingly, among the many objectives of this invention, is to provide a tablet pulverizer for crushing pills or tablets of a spring loaded pliers type device having flat jaws for crushing pills therebetween.

A further objective of this invention is to provide a tablet pulverizer suitable for assisting in the delivery of medicine to an infant.

A still further objective of this invention is to provide a tablet pulverizer suitable for assisting in the delivery of medicine to an elderly person.

Yet a further objective of this invention is to provide a tablet pulverizer to minimize the difficulty of swallowing a pill.

Also an objective of this invention is to provide a tablet pulverizer to crush a pill in a paper cup with minimized tearing of the paper cup.

Another objective of this invention is to provide a tablet pulverizer to crush a pill in a prepackaged container with minimized tearing of the prepackaged container.

Still another objective of this invention is to provide a tablet pulverizer, which avoids crushing a pill in a door jamb.

Yet another objective of this invention is to provide a tablet pulverizer, which avoids pounding to crush a pill.

A further objective of this invention is to provide a tablet pulverizer, which avoids causing noise.

A still further objective of this invention is to provide a tablet pulverizer which is easily cleaned.

Yet a further objective of this invention is to provide a tablet pulverizer which is not contaminated by use.

Also an objective of this invention is to provide a tablet pulverizer to crush a pill for dispersing the pill into a soft food.

Another objective of this invention is to provide a durable tablet pulverizer.

Still another objective of this invention is to provide a method for efficient dispensing of tablet medicine by simplifying the tablet pulverization.

Yet another objective of this invention is to provide a method for efficient dispensing of tablet medicine by dispersing the same in a food.

These and other objectives of this invention (which other objectives become clear by considering the specification, claims and drawings as a whole) are met by providing a tablet pulverizer for crushing a pill or tablet, wherein the pulverizer includes a convex arm and concave arm. The concave arm has a smooth, arcuate crushing surface which nests' with a smooth, convex crushing surface at the convex arm. The meshing of these smooth, arcuate, nesting arms provide a substantial crushing surface to be applied to the pill or tablet for crushing the same without damaging the pill container.

BRIEF DESCRIPTION OF DRAWINGS

Throughout the figures of the drawing where the same part appears in more than one figure of the drawing, the same number is applied thereto.

DESCRIPTION OF THE PREFERRED EMBODIMENTS

The tablet pulverizer of this invention has a convex arm and a concave arm. The concave arm has an arcuate crushing surface which nests with a convex crushing surface at the convex arm. The arcuate crushing surface is substantially flat on one axis perpendicular to the arm axis, and has a chord of the arc substantially parallel to the arm axis. Thus the concave crushing surface is inwardly arcuate, and the convex crushing is outwardly arcuate. The first convex arm is the pliers arm including the outwardly arcuate crushing surface. The second concave arm is the pliers arm including the inwardly arcuate crushing surface. The meshing of these arcuate and nesting arms provide a substantial crushing surface for the pill.

A great advantage of this tablet pulverizer is in its hand-held capability. A nurse can control the pressure applied, thus having control over the degree with which he or she is pulverizing the tablet. This feature allows the nurse to crush the pills while they are still in the unit dose package (as supplied by most pharmacies for institutional use).

Also, this feature avoids the problem caused by some pill crushers, which require the nurse to take the pill out of the package and place them in another receptacle before crushing, thereby saving substantial time. Crushing in the package also allows the nurse to keep medications aside when giving it to the resident while she takes necessary vital signs—for example, as in the case of taking a pulse before giving the heart medication Digoxin.

Another great advantage of this tablet pulverizer is found in its spring-release handle. This release speeds up the pill crushing, because the user is not taking the action of separating the handles to open the jaws for the next compression. It also lends to the comfort of the tablet pulverizer itself and puts little or no strain on the wrist or arm of the user.

Furthermore, this tablet pulverizer is easy to clean. The smooth jaws can be wiped off with water or alcohol or disinfectant, should the need arise or during the routine cleaning program. This is clearly an important infection control feature. There are also no crevices in the crushing jaws to harbor particles of the pills, should the package break open slightly.

The tablet pulverizer is rustproof and corrosion proof. Durability is another strong point. This device can hold up indefinitely (for literally thousands of crushes) and is especially designed for institutional use.

Figure 1:
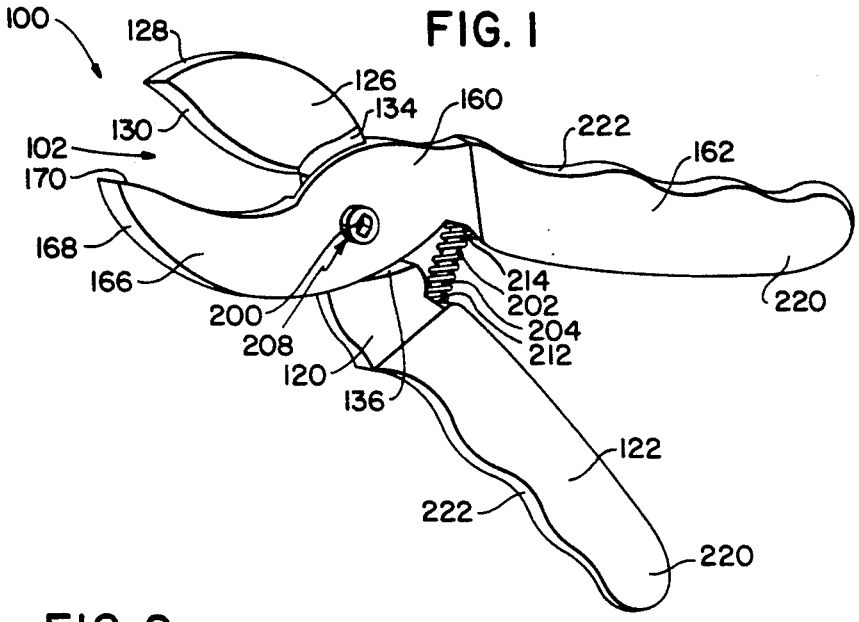
FIG. 1 is a front perspective view of tablet pulverizer 100 of this invention in open position 102.

Referring now to FIG. 1, tablet pulverizer 100 includes a first convex arm 120 and a first concave arm 160 shown in open position 102. Convex arm 120 includes a convex handle 122 at one end thereof. Oppositely disposed from convex handle 122 is convex jaw 126. Convex jaw 126 includes convex jaw head 128 which is an outer side of convex jaw 126. Convex crushing surface 130 of convex jaw 126 is oppositely disposed from convex jaw head 128.

Concave arm 160 includes a concave handle 162 at one end thereof. Oppositely disposed from concave handle 162 is concave jaw 166. Concave jaw 166 includes concave jaw head 168 which is an outer side of concave jaw 166. Concave crushing surface 170 of concave jaw 166 is oppositely disposed from concave jaw head 168. The convex crushing surface 130 is operated to come adjacent to or substantially nestable with concave jaw 166 by jointly squeezing convex handle 122 and concave arm 162.

Figure 3:
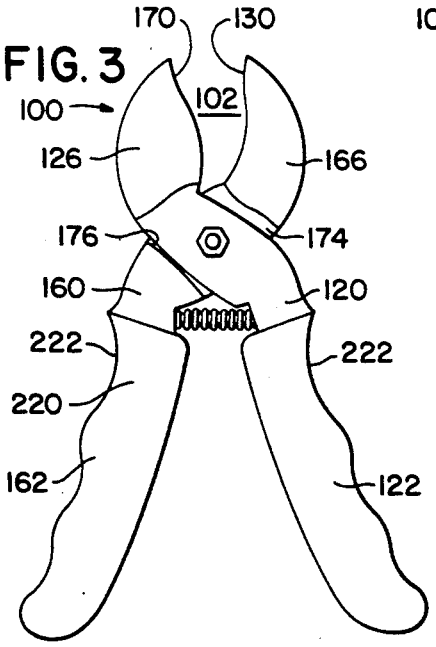
FIG. 3 is a rear plan view of tablet pulverizer 100 of this invention, which is a reverse view of FIG. 1, but in an open position.
Figure 4:
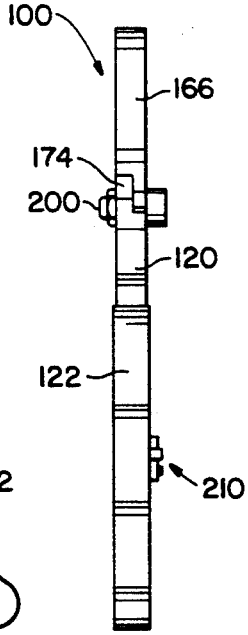
FIG. 4 is a side perspective view of tablet pulverizer 100 of this invention, the reverse view being substantially similar thereto.

In FIG. 1, FIG. 3, and FIG. 4, convex slot 134 between convex jaw 126 and convex handle 122 permits a joining of the concave arm 160 to convex arm 120. Such adjoining permits concave arm 160 to pivot about convex arm 120 by joining rod 200. On concave arm 160 as a part of concave slot 174 is a ledge that rests at the bottom edge thereby forming bottom concave slot edge 176 of the concave slot 174. On convex arm 130 as a part of convex slot 134 is a ledge that rests at the bottom edge thereby forming bottom convex slot edge 136 of the convex slot 134.

In this fashion, convex crushing surface 130 and concave crushing surface 170 are separable or closable as required. Open position 102 is restricted by contact between bottom convex slot edge 136 and bottom concave slot edge 176. Closed position 104 is restricted by contact between convex crushing surface 130 and concave crushing surface 170.

Convex arm 120 and concave arm 160 (and logically convex jaw 126 and concave jaw 166) are joined by a joining rod 200 through convex aperture 206 and concave aperture 208 in the respective jaws. This joining rod 200 is secured therein by bolting or an otherwise suitable device, and forms a pivot point for the purpose of operating concave jaw 166 relative to convex jaw 126.

Within concave handle 162 and convex handle 122 and adjacent joining rod 200 are a convex spring rod aperture 212 and a concave spring rod aperture 214, respectively. Convex spring rod aperture 212 is in convex handle 122. Concave spring rod aperture 214 is in concave handle 166. Spring rod 204 fits in each aperture and is surrounded by a spring 202. In this fashion, the spring 202 is solidly mounted and assists the separation of the concave jaw 166 and the convex jaw 126.

Both concave handle 162 and convex handle 122 may each include a cover 220 thereon. The cover 220 gives the tablet pulverizer 100 a better feel for the user while carrying or using the same. Cover 220 is usually made of a shaped sheet material and colored as desired.

Furthermore both concave handle 162 and convex handle 122 may each have finger indentations 222 thereon. The indentations receive the fingers of a user and also give the tablet pulverizer 100 a better feel for the user while carrying or using the same.

Figure 2:
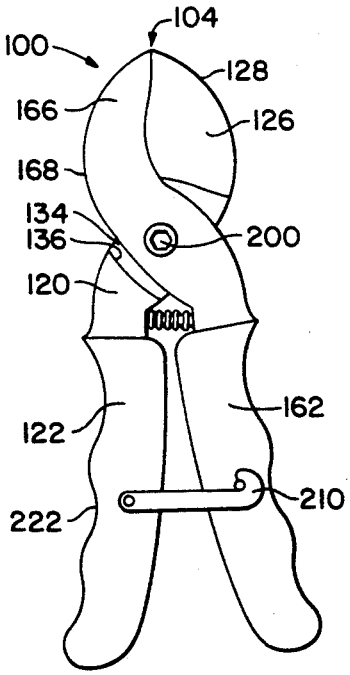
FIG. 2 is a front plan view of tablet pulverizer 100 of this invention in a closed position 104.

Referring now to FIG. 2, handle lock 210 snaps onto convex handle 132 and concave handle 172 to hold the tablet pulverizer 100 in a closed position 104 when not in use. The arcuate shapes of convex crushing surface 130 and concave crushing surface 170 provide for an efficient method of crushing a pill or tablet.

The flat surface of the convex crushing surface 130 and the concave crushing surface 170 combine to minimize, or even eliminate the breakage of the pill container whether it be a pill cup or prepackaged container. The flat surfaces are also easily cleanable and permit the use of crushing pills efficiently.

Convex crushing surface 130 and concave crushing surface 170 are both smooth, arcuate, nestable surfaces. The arcuate nature combined with smoothness of the durable tablet pulverizer 100 provides tremendous improvement in pill or tablet crushing or pulverizing, and cleaning of the tablet pulverizer 100. Preferably, convex crushing surface 130 and concave crushing surface 170 are both up to about three and one-half (3.5) inches (nine centimeters) long. More preferably, convex crushing surface 130 and concave crushing surface 170 are both about one inch (2.5 centimeters) to about three (3.0) inches (7.6 centimeters) long. Most preferably, convex crushing surface 130 and concave crushing surface 170 are about one and one-half (1.5) inches (3.8 centimeters) to about two and one-half (2.5) inches (6.4 centimeters) long. These lengths are measured on the arc length.

The arcs of each of convex crushing surface 130 and concave crushing surface 170 are based on a circle having a radius of up to about ten (10) inches (25 centimeters). More preferably, the arc is based on a circle having a radius of about two (2) inches (5.1 centimeters) to about nine (9) inches (22.9 centimeters). Most preferably, the arc is based on a circle having a radius of about three (3) inches (7.6 centimeters) to about eight (8) inches (20.3 centimeters).

Preferably concave handle 162 and convex handle 122 are up to about seven (7) times as long as the convex crushing surface 130 and concave crushing surface 170. More preferably concave handle 162 and convex handle 122 are about two (2) to about six (6) times as long. Most preferably concave handle 162 and convex handle 122 are about three (3) to about five (5) times as long.

Clearly, tablet pulverizer 100 can be any suitable size. The defined sizes are known to give the best results.

While it is not desired to be bound by any particular theory, it is believed that the smooth, flat arcuate surfaces of the convex crushing surface 130 and concave crushing surface 170 and the nesting thereof leads to crushing and pulverizing as opposed to merely flattening. Also tearing of the unit-dose package is avoided.

The tablet pulverizer 100 of this invention can be made of any suitable material. Preferably, the material is medical quality stainless steel. The stainless steel provides both the durability and cleanability (or sterilizing capability) required in medical situations. A high impact synthetic resin may also be suitable, provided the qualities thereof are medically suitable.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A tablet pulverizer for crushing a tablet used as medicine, wherein:

a. said tablet pulverizer has a first arm and a second arm;

b. said first arm has a first handle at one end thereof and a jaw having a first crushing surface at an opposing end thereof;

c. said second arm has a second handle at one end thereof and a jaw having a second crushing surface at an opposing end thereof;

d. said tablet pulverizer has a pivotal connecting means pivotally joining said first arm to said second arm;

e. said pivotal connecting means is situated between said first handle at one end and said first crushing surface;

f. said pivotal connecting means is situated between said second handle at one end and said second crushing surface;

g. said first arm is movably adjacent to said second arm;

h. said first crushing surface is movably adjacent to said second crushing surface;

i. said first crushing surface is arcuate along a first axis for said first arm;

j. said second crushing surface is arcuate along a second axis for said second arm;

k. said first crushing surface and said second crushing surface are smooth, flat and nestable, one upon the other;

l. said first crushing surface is flat along an axis perpendicular to said first axis; and m. said second crushing surface is flat along an axis perpendicular to said second axis.

2. The tablet pulverizer of claim 1 wherein said first arm jaw crushing surface is concave.

3. The tablet pulverizer of claim 1 wherein said second arm jaw crushing surface is convex.

4. The tablet pulverizer of claim 3, wherein:

a. said tablet pulverizer includes a spring release means to assist said tablet pulverizer moving from a closed position to an open position;

b. said tablet is insertable between said convex crushing surface and said concave crushing surface when said tablet pulverizer is in said open position; and c. said tablet is crushable between said convex crushing surface and said concave crushing surface when said tablet pulverizer approaches said closed position.

5. The tablet pulverizer of claim 3, wherein:

a. a convex jaw is oppositely disposed from said first handle as a part of said first arm;

b. said convex jaw includes said convex crushing surface and a convex jaw head oppositely disposed from said convex crushing surface;

c. a concave jaw is oppositely disposed from said second handle as a part of said second arm; and d. said concave jaw includes said concave crushing surface and a concave jaw head oppositely disposed from said concave crushing surface.

6. The tablet pulverizer of claim 5, wherein:

a. said first arm includes a convex slot between said convex jaw and said first handle;

b. said second arm includes a concave slot between said concave jaw and said second handle; and c. said convex slot is joined to said concave slot by said pivotal connecting means.

7. The tablet pulverizer of claim 6, wherein:

a. said pivotal connecting means includes a joining rod;

b. said convex slot includes a bottom convex slot edge;

c. said concave slot includes a bottom concave slot edge; and d. said convex slot and said concave slot restrict separation of said concave crushing surface and said convex crushing surface.

8. The tablet pulverizer of claim 7, wherein:

a. said concave slot includes a concave joining rod aperture to pivotally receive said joining rod; and b. said convex slot includes a convex joining rod aperture to pivotally receive said joining rod.

9. The tablet pulverizer of claim 8, wherein:

a. said second arm handle includes a concave spring rod aperture substantially perpendicular to and adjacent to said concave joining rod aperture;

b. said first arm handle includes a convex spring rod aperture substantially perpendicular to and adjacent to said convex joining rod aperture;

c. said concave spring rod aperture said convex spring rod aperture receive a spring rod aperture; and d. a spring surrounds said spring rod.

10. The tablet pulverizer of claim 9, wherein said second handle and said first handle each include a cover.

11. The tablet pulverizer of claim 10, wherein said handles include a locking means to hold said convex crushing surface adjacent to said concave crushing surface.

12. The tablet pulverizer of claim 9, wherein:

a. said convex crushing surface and said concave crushing surface are up to about nine centimeters long as measured on an arc length;

b. said arc length is based on a circle having a radius of up to 25 centimeters; and c. each said handle is up to about seven times as long as said respective crushing surface.

13. The tablet pulverizer of claim 12, wherein:

a. said arc length is about 2.5 centimeters to about 7.6 centimeters;

b. said arc radius of is part of a circle having a radius of about 5.1 centimeters to about 22.9 centimeters; and c. each said handle is about two to about six times as long as said respective crushing surface.

14. The tablet pulverizer of claim 13, wherein:

a. said arc length is about 3.8 centimeters to about 6.4 centimeters;

b. said arc radius of is part of a circle having a radius of about 7.6 centimeters to about 20.3 centimeters; and c. each said handle is about three to about five times as long as said respective crushing surface.

* * * * *